US006585502B2

(12) United States Patent
Fenocchi

(10) Patent No.: US 6,585,502 B2
(45) Date of Patent: Jul. 1, 2003

(54) SCROLL COMPRESSOR WITH SLIDER BLOCK HAVING CIRCULAR PORTIONS IN AN INNER BORE

(75) Inventor: David M. Fenocchi, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/034,618

(22) Filed: Dec. 27, 2001

(65) Prior Publication Data

US 2002/0110473 A1 Aug. 15, 2002

Related U.S. Application Data

(63) Continuation-in-part of application No. 09/783,280, filed on Feb. 13, 2001, now Pat. No. 6,428,294.

(51) Int. Cl.[7] ..... F04C 18/04
(52) U.S. Cl. ..... 418/55.5
(58) Field of Search ..... 418/55.5, 57

(56) References Cited

U.S. PATENT DOCUMENTS 5,017,107 A * 5/1991 Fraser et al. ..... 418/55.5
5,433,589 A * 7/1995 Wada et al. ..... 418/55.5
5,575,635 A * 11/1996 Yamamoto et al. ..... 418/55.5
5,582,513 A * 12/1996 Shigeoka et al. ..... 418/55.5
5,588,819 A * 12/1996 Wallis ..... 418/55.5

FOREIGN PATENT DOCUMENTS

JP 4-50489 * 2/1992 ..... 418/55.5

* cited by examiner

*Primary Examiner*—John J. Vrablik
(74) *Attorney, Agent, or Firm*—Carlson, Gaskey & Olds

(57) ABSTRACT

An improved slider block for a scroll compressor has a bore including two spaced circular portions centered on a common axis. A recess is formed into one of the curved portions to provide additional clearance for movement of an eccentric pin. The recess allows the eccentric pin to move within the bore, as the relative position of the slider block and the eccentric pin move and change during operation of the scroll compressor. In a further embodiment, chamfers are formed at circumferential ends of a non-drive flat surface to merge that non-drive flat surface into the circular portions. This will ensure the slider block is properly positioned on smaller eccentric pins.

8 Claims, 2 Drawing Sheets

SCROLL COMPRESSOR WITH SLIDER BLOCK HAVING CIRCULAR PORTIONS IN AN INNER BORE

This application is a continuation-in-part of prior filed U.S. patent application Ser. No. 09/783,280, filed Feb. 13, 2001 U.S. Pat. No. 6,828,294.

BACKGROUND OF THE INVENTION

This invention relates to a slider block for a scroll compressor wherein the inner bore of the slider block has a clearance recess to allow for movement of the eccentric pin that moves relative to the slider block bore.

Scroll compressors are becoming widely utilized in refrigerant compression applications. In a scroll compressor a first scroll member has a generally spiral wrap extending from a base. A second scroll member has its own wrap which interfits with the spiral wrap of the first scroll member. The second scroll member is caused to orbit relative to the first scroll member to entrap and then compress a refrigerant. The second scroll member is generally driven to orbit by an electric rotary motor driving the second scroll member through a Oldham coupling. The connection between the driveshaft of the motor and the orbiting scroll is through a slider block, such that the second scroll has the ability to move relative to the first scroll under certain circumstances. Typically, the shaft has an eccentric pin extending upwardly into an opening in the slider block. The opening has a flat drive surface that is in contact with a barrel shaped drive surface on the eccentric pin. The bore of the slider block has two opposed circular surfaces. The pin may slide relative to the flat surface on the slider block, such that the orbiting scroll can move towards and away from the wrap on the first scroll member.

In one type of slider block, the accurate surfaces that define the two curved portions of the bore need to be spaced relatively far inwardly to provide for additional structure on the outer periphery of the slider block. In particular, one type of slider block has an oil notch at its side. The formation of the oil notch requires that the curved surface be spaced relatively far inwardly to provide for sufficient wall thickness. However, if the wall is sufficiently thick such that the curved surface is spaced inwardly, it may well be there is insufficient clearance for the pin to move to certain positions without contacting the opposed curved surface.

The present invention is directed to addressing the above-mentioned problem.

SUMMARY OF THE INVENTION

A scroll compressor is provided with a slider block having a pair of curved opposed surfaces. The surfaces are preferably centered on a common center line. A pair of drive flats separates the two curved surfaces. A recess is formed into one of the two curved surfaces to provide additional clearance for movement of the eccentric pin. Preferably the recess is generally opposed to structure on the outer periphery of the slider block; the structure is preferably a notch to allow for flow of oil. The notch is associated with one of the two curved surfaces, and the curved surface is spaced inwardly from the notch to provide sufficient wall thickness. The inwardly spaced curved surface results in the need for additional clearance provided by the recess.

In one embodiment, structure is provided to ensure the slider block is positioned in the proper alignment on the eccentric pin. Chamfers are provided on one of the flat surfaces to ensure that the slider block cannot be improperly positioned.

These and other features of the present invention can be best understood from the following specification and drawings, the following of which is a brief description.

DETAILED DESCRIPTION OF A PREFERRED EMBODIMENT

Figure 1:
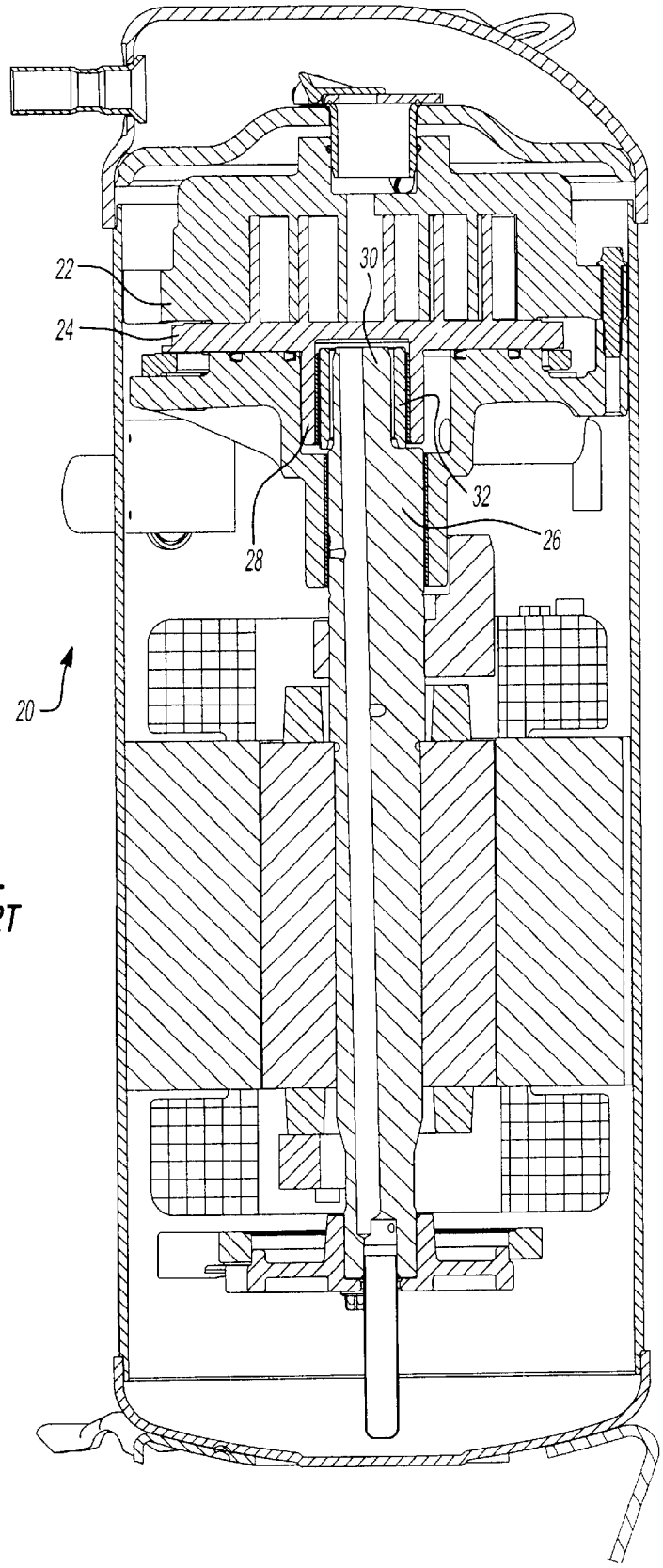
Fig-1 PRIOR ART
FIG. 1 is a cross-sectional view through a scroll compressor.

FIG. 1 illustrates a scroll compressor 20 having a non-orbiting scroll 22 and an orbiting scroll 24. As known, a driveshaft 26 is driven to rotate, and has an eccentric pin 30 extending upwardly into a bore 28 in the orbiting scroll 24. A slider block 32 is positioned between the pin 30 and the bore 28.

Figure 2:
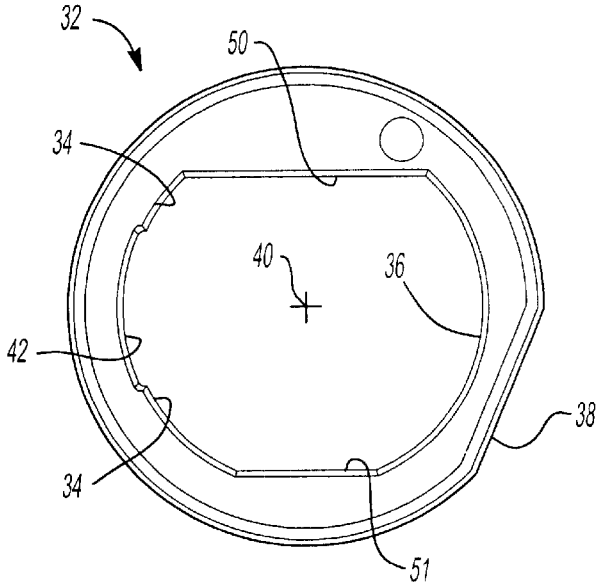
FIG. 2 is a cross-sectional view through the inventive slider block.

As shown in FIG. 2, the slider block 32 has an inner peripheral bore defining a first curved surface 34 with two circumferentially spaced portions, and an opposed second curved surface 36. Intermediate the two curved portions 34 is a curved recess 42. Curved surfaces 34, 36 and 42 are all centered on a common point 40. Thus, surfaces 34 and 36 are essentially portions of the same circle, whereas portion 42 is a circle with the same center, but a slightly larger radius. As shown, a notch 38 is formed on the outer periphery of the slider block 32. The notch 38 allows for oil flow between the slider block and the bearing generally positioned outwardly of the slider block which is visible in FIG. 1.

Figure 3:
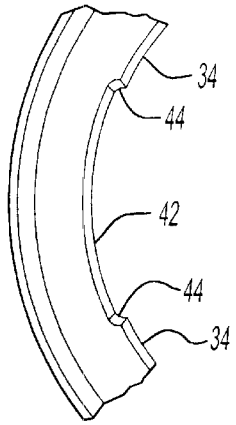
FIG. 3 shows a portion of the FIG. 2 slider block.

FIG. 3 is an enlarged view of the recess 42. As can be seen, end ledges 44 of the recess 42 merge into the curved portions 34.

Figure 4:
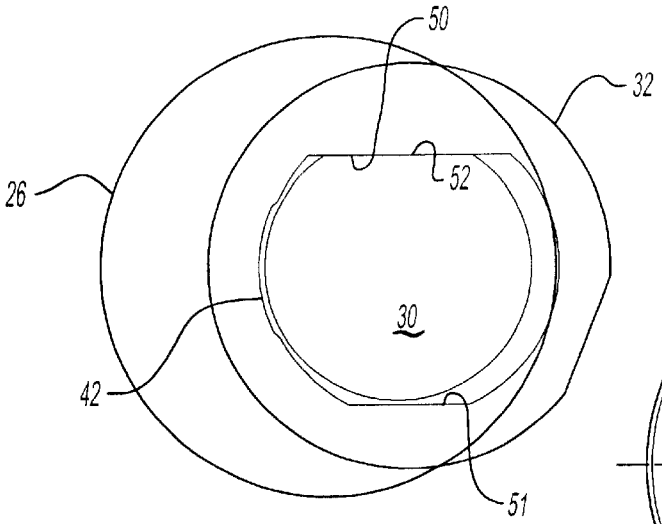
FIG. 4 is a cross-sectional view showing the inventive slider block and the eccentric drive pin.

FIG. 4 shows the eccentric pin 30 received within the bore. The eccentric pin is shown in the position where it is spaced as far to the left in this figure as it will typically be. As can be seen, a portion of the outer periphery of the eccentric pin 30 would now extend into the recess 42. If the recess 42 were not there, there could be contact, which would be undesirable. Further, as is shown in FIG. 4, the flat 50 within the bore of the slider block is in driving engagement with a barrel surface 52 from the drive pin 30.

As is also clear, an opposed flat portion 51 is spaced from a curved portion of the eccentric pin 30 wherein the surface 50 and 52 are in driving engagement. As can be appreciated from this figure, the circumferential extent of the portion 51 is less than the circumferential extent of the portion 50.

Figure 5:
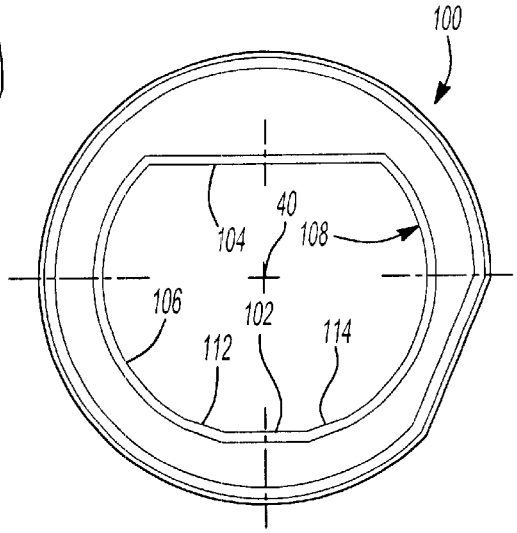
FIG. 5 adds a further embodiment.

FIG. 5 shows another embodiment 100 wherein the two flat surfaces 102 and 104 are connected with circular arcs 106 and 108 as in the prior embodiments. A recess may also be provided as in the prior embodiments. Notably, chamfer portions 112 and 114 are positioned adjacent the flat surface 102 which does not provide a drive surface with the eccentric pin. These chamfer surfaces ensure that the slider block cannot be improperly positioned on the eccentric pin. In some applications, wherein the eccentric pin is smaller, the earlier embodiment may be subject to allowing the slider block to be positioned improperly, or in a reverse manner. This would be undesirable. The chamfer portions will prevent this improper positioning from occurring.

A preferred embodiment of this invention has been disclosed. However, a worker in this art would recognize that certain modifications would come within the scope of this invention. For that reason the following claims should be studied to determine the true scope and content of this invention.

What is claimed is:

1. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss; and a slider block received between said eccentric pin and said boss of said second scroll member, said slider block having an inner bore receiving said eccentric pin, with said slider block and said eccentric pin having a surface in engagement for transmitting movement, said eccentric pin surface being a generally flat surface, and said eccentric pin having an opposed curved surface, said bore of said slider block including a pair of circumferentially spaced curved portions, with a pair of generally flat portions which are positioned circumferentially intermediate spaced circumferential ends of said pair of curved portions, one of said generally flat portions provides a portion of said surface for engaging said eccentric pin and transmitting movement, with the other of said flat portions being connected to merge into said curved portions, and said eccentric pin portion being engaged with said one generally flat surface, and said eccentric pin curved surface being spaced from said other flat portion of said bore when transmitting movement.

2. A scroll compressor as recited in claim 1, wherein chamfers adjacent each end of said other generally flat portion merge said flat portion into said curved portions.

3. A scroll as recited in claim 2, wherein said curved portions are circular arcs centered on a common axis.

4. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss; and a slider block received between said eccentric pin and said boss of said second scroll member, said slider block having an inner bore receiving said eccentric pin, with said slider block and said eccentric pin having surfaces in engagement for transmitting movement, said bore of said slider block including a pair of circumferentially spaced curved portions, said curved portions being circular arcs centered on a common axis, with a pair of generally flat portions which are positioned circumferentially intermediate spaced circumferential ends of said pair of curved portions, one of said generally flat portions providing a contact surface for contacting said eccentric pin and transmitting movement, the other of said flat portions being connected to merge into said curved portions at a location opposed to said one generally flat portion, said eccentric pin having an engagement portion engaged with said one generally flat portion to transmit movement, said eccentric pin having an opposed curved surface from said engagement portion, said eccentric pin being spaced from said other generally flat portion, and wherein portions which are non-parallel to said other generally flat portion which does not contact said eccentric pin as a drive surface are formed to merge said other generally flat portion into said circumferential ends of said circular portions.

5. A scroll compressor as recited in claim 4, wherein said non-parallel portions are chamfer portions.

6. A scroll compressor as recited in claim 4, wherein one of said generally flat portions provides a portion of said surface for engaging said eccentric pin and transmitting movement, with the other of said flat portions being connected to merge into said curved portions, and said eccentric pin portion being engaged with said one generally flat surface, and said eccentric pin curved portion being spaced from said other flat portion of said bore when transmitting movement.

7. A scroll compressor as recited in claim 4, wherein said other generally flat portion being smaller than said one generally flat portion.

8. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss; and a slider block received between said eccentric pin and said boss of said second scroll member, said slider block having an inner bore receiving said eccentric pin, with said slider block and said eccentric pin having surfaces in engagement for transmitting movement, said eccentric pin surface being a generally flat surface, and said eccentric pin having an opposed curved surface, said bore of said slider block including a pair of circumferentially spaced curved portions, with a pair of generally flat portions which are positioned circumferentially intermediate spaced circumferential ends of said pair of curved portions, said other generally flat portion being circumferentially smaller than said one generally flat portion, and said eccentric pin curved surface being spaced from said other generally flat portion when transmitting movement.

* * * * *